United States Patent [19]

Selle

[11] Patent Number: 4,648,595

[45] Date of Patent: Mar. 10, 1987

[54] BENCH PRESS SAFETY PLATFORM WITH UNLOADING SHELF

[76] Inventor: Robert W. Selle, 6157 Pershing Ave., Downers Grove, Ill. 60516

[21] Appl. No.: 744,541

[22] Filed: Jun. 14, 1985

[51] Int. Cl.[4] ..... A63B 13/00

[52] U.S. Cl. ..... 272/123; 272/DIG. 4

[58] Field of Search ..... 272/122, 123, 117, 118, 272/134, 93, 144, DIG. 4

[56] References Cited

U.S. PATENT DOCUMENTS

| | | | |
|---|---|---|---|
| 3,118,668 | 1/1964 | Callahan | 272/123 |
| 3,948,513 | 4/1976 | Pfotenhauer | 272/134 |
| 4,205,838 | 6/1980 | McIntosh | 272/123 |
| 4,262,901 | 4/1981 | Faust | 272/117 |
| 4,302,009 | 11/1981 | Johnson | 272/123 |
| 4,306,715 | 12/1981 | Sutherland | 272/117 |
| 4,368,884 | 1/1983 | Colvin | 272/123 |
| 4,411,425 | 10/1983 | Milnar | 272/123 |

*Primary Examiner*—Richard J. Apley
*Assistant Examiner*—John L. Welsh
*Attorney, Agent, or Firm*—Richard C. Litman

[57] ABSTRACT

A bench press safety apparatus provided with safety shelves or platforms for receiving outer ends of a barbell when a lift thereof is missed or defective, and then further provided with reversible unloading members to allow the barbell to be rolled from the safety shelves or platforms to an unloading position in which the ends of the barbell are free for removal of the weights.

9 Claims, 3 Drawing Figures

BENCH PRESS SAFETY PLATFORM WITH UNLOADING SHELF

BACKGROUND OF THE INVENTION

1. Field of the Invention

The invention relates to apparatus for protecting a weight lifter who, during performance of weight lifting exercises using a bench press apparatus, finds that he is unable to complete an exercise and return the barbell to its upper, receiving position.

2. Description of the Prior Art

The recent interest in physical fitness is leading more and more persons to engage in a regular program of exercising in order to improve and maintain their personal fitness. Exercises such as jogging, aerobics, tennis, racquetball and weight lifting have enjoyed a great increase in interest in recent years.

The increasing pressures and time constraints of modern life have dictated that many persons perform their exercise routines alone, rather than in the company of others. In the case of weight lifting, and in particular, use of a brench press, this solo exercising can be quite dangerous. If, in the middle of a bench pressing exercise one finds that one cannot complete a lift of the barbell, injury can occur when collapse of the weight lifter's arms allows the barbell to contact his chest, neck or head.

There have been numerous attempts in the prior art to preclude such injury by the provision of safety stands for use during bench press exercises. To date, these safety stands have been cumbersome to use, and somewhat ineffectual. Simple safety stands, such as those provided by McIntosh in U.S. Pat. No. 4,205,838, present a rather small target for an exhausted weight lifter to engage with the barbell weights, and are also provided with a rather narrow base portion, which might allow the stands to tip over if the barbell is misaligned at the time contact, is made with the stand. Milnar, U.S. Pat. No. 4,411,425, provides safety stands which are rigidly attached to the weight lifting bench but they again represent a rather small target for an exhausted weight lifter with a heavy barbell, the target being placed in an awkward position also.

Other prior art devices of note include U.S. Pat. No. 4,262,901 to Faust and U.S. Pat. No. 4,368,884 to Colvin. While the Faust device provides sufficient stability for the safety apparatus, as well as an adequate target for the weight lifter, its design can easily interfere with exercises which the weight lifter may wish to perform. Also, with the use of larger weight disks, the barbell must be assembled within the safety device in order for proper use to occur. A deficiency of the Colvin apparatus is that, once the barbell has been laid to rest upon the safety apparatus, weights cannot be removed from the barbell until it is relocated to the bench press barbell holder. This may not be possible in the case of a weight lifter exercising alone, and thus, he will be unable to perform any additional exercises until help arrives so that he may relocate and unload the bar.

SUMMARY OF THE INVENTION

This invention relates to a bench press safety apparatus which will not only protect a weight lifter against injury in case he is unable to perform an exercise to completion, but also provides unloading shelves in order that the barbell weights may be changed, and an individual exerciser may continue with his lifting program.

DESCRIPTION OF THE PREFERRED EMBODIMENTS

Figure 1:
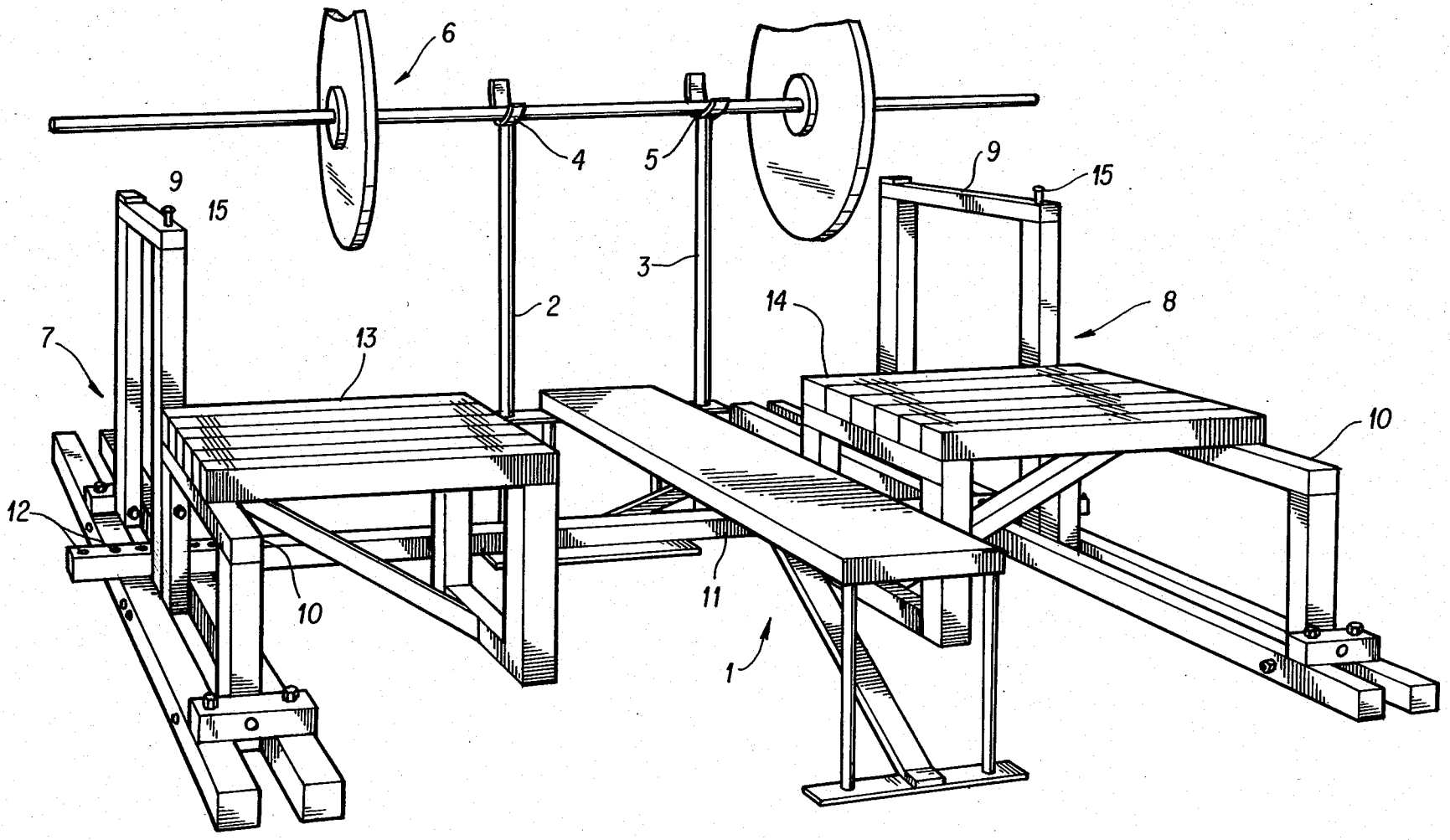
FIG. 1 is a perspective view of a wooden embodiment of the invention, with the barbell resting on its bench press supports, and the unloading shelves in their unloading position.

Two different embodiments of the invention are contemplated, one made of wood for economy, and another made of metal to facilitate adjustability. Both are basically similar in concept and design, and will, for the most part, be described interchangeably. This model can be made adjustable by using the flat board shim members to raise the bench closer to the barbell bar for use by smaller persons, and likewise, shim boards used on the unloading shelves could accommodate smaller weight disks.

The standard bench press apparatus is shown at 1, including barbell support arms 2 and 3, and support saddles 4 and 5. Barbell 6 is located atop saddles 4 and 5.

The basic safety apparatus includes left- and right-hand support bridges 7 and 8. Each of the bridges includes upper safety support 9 and lower shelf support 10. Bridges 7 and 8 are joined by connector beam 11, each end of which is provided with a plurality of mounting holes 12 to allow adjustability of the working width between bridges 7 and 8 for use with a variety of bar lengths for barbell 6. Connector beam 11 not only allows adjustment of the width of the safety support 9 and 10, but also provides stability in the lateral direction for bridges 7 and 8. Safety unloading shelves or platforms 13 and 14 are shown here mounted in their unloading positions.

Figure 2:
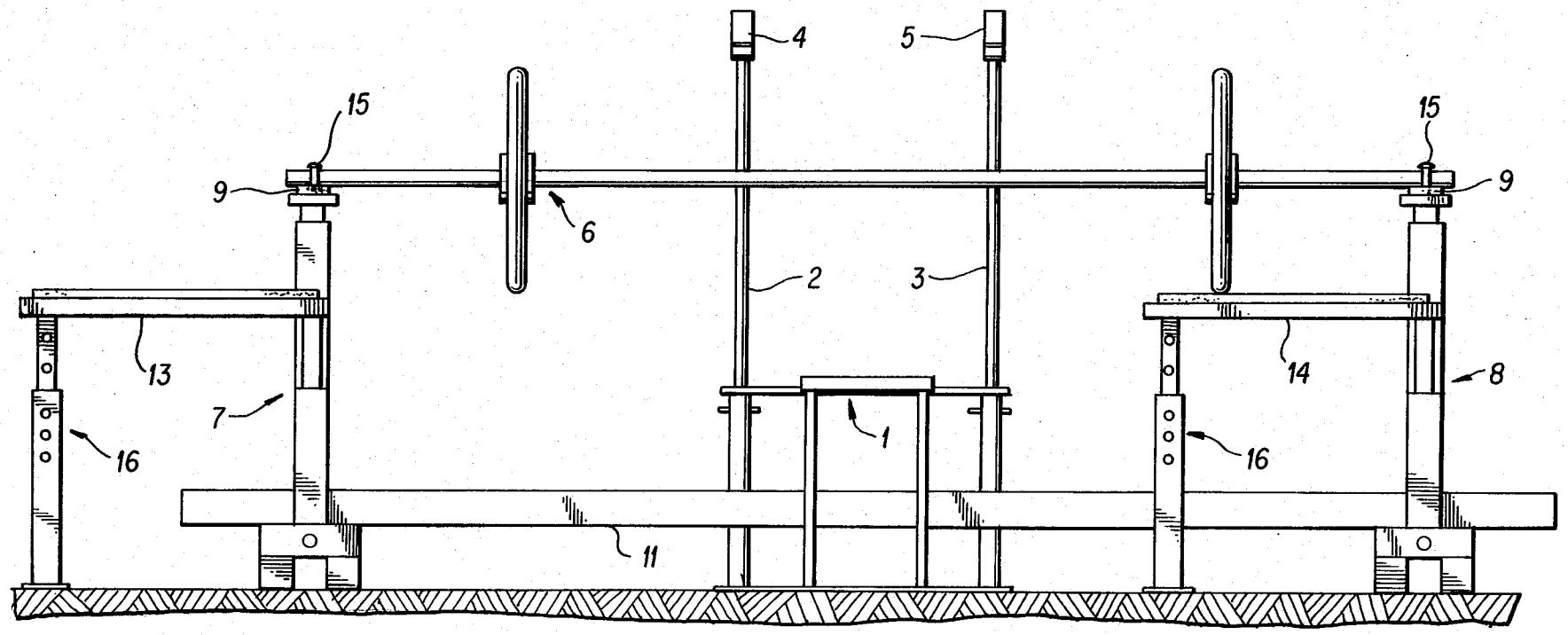
FIG. 2 is a front plan view of a metal embodiment of the invention, with the barbell resting upon its safety supports, the left-hand unloading platform in its storage position, and the right-hand unloading shelf in use.

The metal version of the invention shown in FIG. 2 is quite similar to that of the wooden version of FIG. 1. It includes bench apparatus 1, with barbell support arms 2 and 3, and support saddles 4 and 5. Barbell 6 is shown resting on safety supports 9, with safety pins 15 in place to keep the barbell from rolling off the forward edge of supports 9. Bridges 7 and 8 are shown joined by connector beam 11. Unloading shelf 13 is shown in its storage position, while right-hand unloading shelf 14 is shown in use. The major differences in this metal version of the invention are the telescoping support legs 16, which facilitate adjustability of the unloading shelf height for ease of use with a variety of weight disk diameters. The adjustability feature also allows the proper height difference to be maintained between the safety supports and the unloading shelves to facilitate transfer of the barbell from one to the other, and vice versa.

Figure 3:
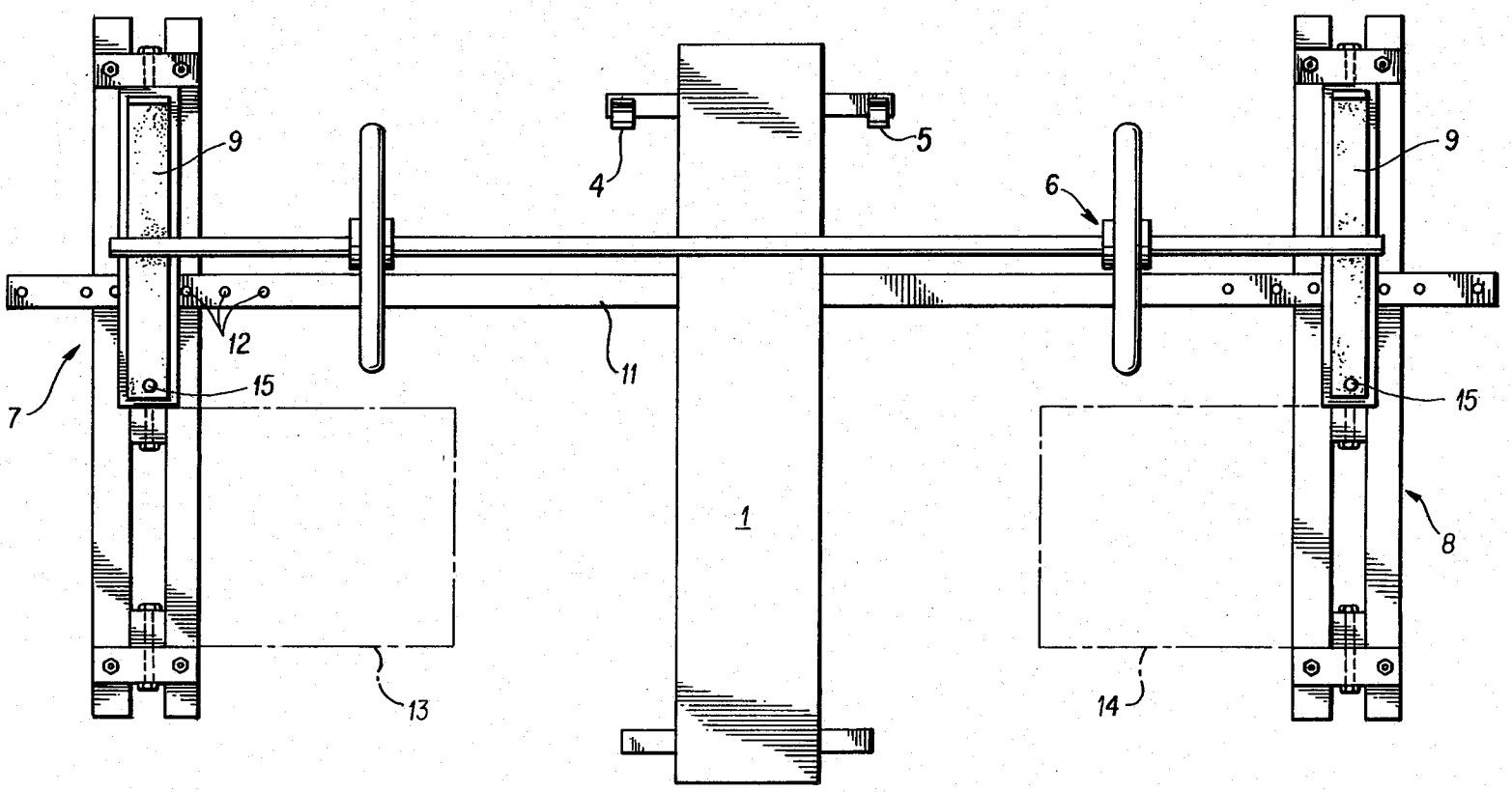
FIG. 3 is a top plan view of the invention, with the barbell located on the safety supports, and the unloading shelves shown in phantom in their unloading positions.

FIG. 3 is a top plan view of the apparatus, again illustrating the basic bench press bench 1, with barbell support saddles 4 and 5 being visible, barbell 6 resting on safety supports 9, and retained thereon by safety pins 15, bridges 7 and 8 interconnected by connector beam 11, and provided with adjustability by a plurality of mounting holes 12. Unloading shelves 13 and 14 are shown in phantom in their unloading positions, illustrating how they extend inwardly far enough to support the weight disks once pins 15 are removed, and barbell 6 is rolled off safety supports 9 onto the unloading shelves. It is also apparent from this view that, once unloading shelves 13 and 14 are turned to their storage positions, there will be no interference with any routine of exercises which a weight lifter may wish to perform.

Proper use of the invention is described as follows: Standard bench press apparatus 1, with barbell support arms 2 and 3, is utilized, with the desired barbell weight located in support saddles 4 and 5. The bench press safety platform of the invention may then be assembled around the basic bench press apparatus. Connector beam 11 is placed to the inside of support arms 2 and 3, allowing full flexibility of positioning of the safety apparatus to accommodate any position desired by the weight lifter, and preclude any interference with his exercises. Bridges 7 and 8 are joined to connector beam 11 through any of the holes 12 provided in the beam so that the distance between bridges 7 and 8 can be adjusted to the length of barbell 6. This distance should be adjusted such that both ends of the barbell may be conveniently rested upon safety supports 9, without the bridges being so close together as to interfere with the lifter's exercising routine.

The safety support may then be adjusted to the desired working height, which is equal to the bench height plus the back-to-front measurement of the athlete's chest as he is lying on the bench so that the bar, when resting on the safety supports, will come close to touching the athlete's chest without placing undue pressure thereon. The unloading shelves may then be adjusted so that they just make contact with the largest plates on the barbell when it is resting on the safety supports prior to being rolled onto the unloading shelves.

Once the assembly of the bridges 7 and 8 and the connector beam 11 are secured, unloading shelves 13 and 14 are placed in their storage positions, extending outwardly from bridges 7 and 8, respectively.

The weight lifter may then recline on bench 1, remove the barbell 6 from support saddles 4 and 5, and proceed with his exercises.

If, during the course of his exercises, the lifter finds that he is unable to complete a lift, and thus unable to relocate barbell 6 in support saddles 4 and 5, he may simply lower the barbell straight down until the ends of the barbell bar 6 contact the safety supports 9, which will remove the barbell from the weight lifter's control, and preclude any injury which might occur upon dropping of the barbell onto his chest, neck or head. Once the barbell 6 is at rest upon safety supports 9, it is retained thereon by safety pins 15. The next step for the solo weight lifter is to remove some of the weight from barbell 6 so that he may continue exercising. Since safety supports 9 are outboard of the weight disks, unloading platforms 13 and 14 must be swung inwardly of bridges 7 and 8, respectively, in order to allow unloading of the barbell. Once the unloading supports 13 and 14 are in their inwardly facing unloading positions, safety pins 15 are removed, and barbell 6 may be safely rolled off safety supports 9 onto the unloading shelves 13 and 14. Now, the ends of the barbell are free, and weight disks may be removed at will. Once enough weight is removed from barbell 6 that the weight lifter can handle it again, he may place it in support saddles 4 and 5, assemble whatever weights are desired, recline again on bench 1, and proceed with further exercises. Once the barbell is again located in support saddles 4 and 5, unloading shelves 13 and 14 may be turned outwardly to their storage positions.

I claim:

1. A bench press safety apparatus for athletes using a barbell with a standard weight lifting bench press, said barbell capable of receiving weight disks thereon, comprising:

left- and right-hand bridge members, said bridge members joined by a connector beam to secure said bridge members at a fixed distance apart and lend stability and rigidity thereto.

said bridge members including upper and lower horizontal support surfaces wherein said lower horizontal support surfaces include respective left- and right-hand unloading means capable of supporting said weight disks and rotating means to allow said lower horizontal support surfaces to be selectively swung inwardly and outwardly of said bridge members serving to locate said lower horizontal support surfaces, in an in use position and storage position, respectively, said upper horizontal support surfaces serving to support the bar ends of a barbell in the event of a failed exercise by a weight lifter using said apparatus, thus precluding injury to said weight lifter by fall and impact of said barbell upon the weight lifter, and said lower horizontal support members serving to locate said left- and right-hand unloading means, such that said weight lifter, having been protected from injury during a failed exercise by said upper horizontal support surfaces, may then reposition said barbell from said upper support surfaces to said left- and right-hand unloading means to facilitate unweighting of the barbell and resumption of the weight lifter's exercise routine.

2. A bench press safety apparatus as described in claim 1, in which said connector beam is provided with at least one mounting hole or slot for securement to said bridge members, thus allowing adjustability of the distance between said bridge members in accordance with the length dimension of the barbell being utilized therewith.

3. A bench press safety apparatus as described in claim 1, in which said upper horizontal support surfaces of said bridge members are provided with removable safety pins located in apertures at the forward end of said upper horizontal support surfaces to preclude said barbell from rolling off said upper horizontal support surfaces until such time as said unloading means are properly located to receive said barbell.

4. A bench press safety apparatus as described in claim 1, in which the lower horizontal support surfaces of said unloading means are telescopically adjustable to facilitate use with a variety of diameters of the weight disks.

5. A bench press safety apparatus as described in claim 3, in which said safety pins when removed allow the barbell to roll from upper horizontal safety surfaces onto the unloading means.

6. A bench press safety apparatus for athletes using a barbell with a standard weight lifting bench press, said barbell capable of receiving weight disks thereon, comprising:

left- and right-hand bridge members, said bridge members joined by a connector beam to secure said bridge members at a fixed distance apart and lend stability and rigidity thereto, said bridge members including upper and lower horizontal support surfaces wherein said lower horizontal support surfaces include respective left- and right-hand unloading means capable of supporting said weight disks and rotating means to allow said lower horizontal support surfaces to be selectively swung inwardly and outwardly of said bridge members serving to locate said lower horizontal support surfaces in an in use position and storage position, respectively, said upper horizontal support surfaces serving to support the bar ends of a barbell in the event of a failed exercise by a weight lifter using said apparatus, thus precluding injury to said weight lifter by fall and impact of said barbell upon the weight lifter, and said left- and right-hand unloading means serving to locate said lower horizontal support surfaces, such that said weight lifter, having been protected from injury during a failed exercise by said upper horizontal support members, may then reposition said barbell from said upper support surfaces to said left- and right-hand unloading means to facilitate unweighting of the barbell and resumption of the weight lifter's exercise routine, said upper horizontal support surfaces of said bridge members being provided with removable safety pins located in apertures at the forward end of said upper horizontal support surfaces to preclude said barbell from rolling off said upper horizontal support surfaces until such time as said unloading means are properly located to receive said barbell.

7. A bench press safety apparatus as described in claim 6, in which said connector beam is provided with at least one mounting hole or slot for securement to said bridge members, thus allowing adjustability of the distance between said bridge members in accordance with the length dimension of the barbell being utilized therewith.

8. A bench press safety apparatus as described in claim 1, in which the lower horizontal support surfaces of said unloading means are telescopically adjustable to facilitate use with a variety of diameters of weights.

9. A bench press safety apparatus as described in claim 1, in which said safety pins when removed allow the barbell to roll off upper horizontal safety surfaces onto the unloading means.

* * * * *